US010233860B2

(12) United States Patent
Detterbeck et al.

(10) Patent No.: US 10,233,860 B2
(45) Date of Patent: Mar. 19, 2019

(54) METHOD FOR STARTING AN INTERNAL COMBUSTION ENGINE

(71) Applicant: Bayerische Motoren Werke Aktiengesellschaft, Munich (DE)

(72) Inventors: Stefan Detterbeck, Munich (DE); Johannes Geiger, Oberschleissheim (DE); Thomas Scheuer, Munich (DE); Tobias Holzinger, Munich (DE); Jochen Merk, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 31 days.

(21) Appl. No.: 15/485,268

(22) Filed: Apr. 12, 2017

(65) Prior Publication Data

US 2017/0218877 A1 Aug. 3, 2017

Related U.S. Application Data

(63) Continuation of application No. PCT/EP2016/051273, filed on Jan. 22, 2016.

(30) Foreign Application Priority Data

Jan. 28, 2015 (DE) ..... 10 2015 2010 414

(51) Int. Cl.
*F02D 41/38* (2006.01)
*F02D 41/06* (2006.01)
(Continued)

(52) U.S. Cl.
CPC ..... *F02D 41/3854* (2013.01); *F02D 41/065* (2013.01); *F02D 41/3082* (2013.01);
(Continued)

(58) Field of Classification Search
CPC ..... F02D 41/3854; F02D 41/065; F02D 41/3082; F02D 2200/0608;
(Continued)

(56) References Cited

U.S. PATENT DOCUMENTS

2003/0145830 A1 8/2003 Joos et al.
2006/0225706 A1 10/2006 Eser et al.
(Continued)

FOREIGN PATENT DOCUMENTS

DE 195 39 885 A1 11/1996
DE 103 00 929 A1 8/2004
(Continued)

OTHER PUBLICATIONS

German-language Search Report issued in counterpart German Application No. 10 2015 201 414.2 dated Nov. 20, 2015 with partial English translation (11 pages).
(Continued)

*Primary Examiner* — Joseph Dallo
(74) *Attorney, Agent, or Firm* — Crowell & Moring LLP

(57) ABSTRACT

A method for starting an internal combustion engine with a fuel tank and a low-pressure pump which pumps gasoline out of the fuel tank at a low-pressure to a high-pressure pump that pumps the gasoline at a high-pressure to injectors of the internal combustion engine. An electronic controller is provided for controlling and/or regulating the low-pressure pump, the high-pressure pump, and the injectors. After a start pulse for the internal combustion engine, the method: checks whether a formation of vapor bubbles in the gasoline is possible on the low-pressure side during a hot start. If not possible, then the normal low-pressure is set. If possible, then a low pressure which is high enough that the formation of vapor bubbles is not possible on the low-pressure side is set, and the normal low-pressure is set after a period of time.
(Continued)

The problem of vapor bubble formation is prevented in an inexpensive or cost neutral manner via the method.

5 Claims, 3 Drawing Sheets

(51) Int. Cl.
*F02M 37/20* (2006.01)
*F02D 41/30* (2006.01)
*F02M 63/02* (2006.01)

(52) U.S. Cl.
CPC ..... *F02M 37/20* (2013.01); *F02M 63/0265* (2013.01); *F02D 2200/021* (2013.01); *F02D 2200/023* (2013.01); *F02D 2200/0608* (2013.01)

(58) Field of Classification Search
CPC ..... F02D 2200/023; F02D 2200/021; F02M 63/0265; F02M 37/20
See application file for complete search history.

(56) References Cited

U.S. PATENT DOCUMENTS

2012/0143475 A1 6/2012 Ryoo et al.
2013/0144507 A1* 6/2013 Lee ..... F02D 41/3082 701/103
2013/0233284 A1* 9/2013 Thaysen ..... F02D 19/0615 123/495
2013/0247874 A1* 9/2013 Saito ..... F02D 41/3854 123/446
2013/0298872 A1* 11/2013 Kojima ..... F02D 41/0025 123/446
2014/0123955 A1* 5/2014 Kojima ..... F02M 37/0047 123/478
2014/0230791 A1* 8/2014 Kojima ..... F02D 41/123 123/446
2014/0251269 A1* 9/2014 Hattar ..... F02D 1/02 123/357
2015/0198081 A1* 7/2015 Surnilla ..... F02D 41/3094 123/294
2016/0153384 A1* 6/2016 Ulrey ..... F02D 41/3082 123/464
2016/0153385 A1* 6/2016 Pursifull ..... F02D 41/3845 123/299

FOREIGN PATENT DOCUMENTS

DE 10 2007 058 229 A 6/2009
DE 10 2011 055 921 A1 6/2012
DE 10 2011 005 662 A1 9/2012
EP 1 544 447 A2 6/2005

OTHER PUBLICATIONS

International Search Report (PCT/ISA/210) issued in PCT Application No. PCT/EP2016/051273 dated Apr. 7, 2016 with English translation (7 pages).
German-language Written Opinion (PCT/ISA/237) issued in PCT Application No. PCT/EP2016/051273 dated Apr. 7, 2016 (5 pages).

* cited by examiner

METHOD FOR STARTING AN INTERNAL COMBUSTION ENGINE

CROSS REFERENCE TO RELATED APPLICATIONS

This application is a continuation of PCT International Application No. PCT/EP2016/051273, filed Jan. 22, 2016, which claims priority under 35 U.S.C. § 119 from German Patent Application No. 10 2015 201 414.2, filed Jan. 28, 2015, the entire disclosures of which are herein expressly incorporated by reference.

BACKGROUND AND SUMMARY OF THE INVENTION

The invention relates to a method for starting an internal combustion engine having a fuel tank and a low pressure pump which conveys gasoline at a low pressure from the fuel tank to a high pressure pump which conveys the gasoline at a high pressure to injectors of the internal combustion engine, wherein an electronic control unit is provided for controlling and/or regulating the low pressure pump, the high pressure pump and the injectors.

At present, a constant low pressure is made available for the fuel supply of a gasoline internal combustion engine, which low pressure is subsequently increased substantially by way of a high pressure pump for the injectors. The low pressure is frequently adjusted via a mechanical pressure regulator which has an opening pressure of typically approximately 5.8 bar, relative (that is to say, with respect to ambient pressure). With the aid of the operating method described in German laid-open specification DE 10 2011 005 662 A1 for an electric fuel pump, the low pressure for the fuel supply of the gasoline internal combustion engine can be reduced as required, since the peak pressure of approximately 5.8 bar is necessary only in a few operating states.

Furthermore, German laid-open specification DE 10 2011 005 662 A1 discloses an operating method for an electric fuel pump which conveys fuel out of a tank of a motor vehicle to a consumer and, in particular, to the input side of a high pressure pump which provides said conveyed fuel at high pressure for the injection into the combustion chambers of an internal combustion engine. With regard to its conveying performance, the electric fuel pump is pilot controlled using a requirement characteristic diagram which takes an operating variable of the internal combustion engine and at least one further boundary condition into consideration.

The maximum possible pressure in the low pressure region of the fuel system also cannot be raised briefly in the case of a mechanical pressure regulator with an opening pressure of approximately 5.8 bar with respect to ambient pressure, in order to counteract the formation of vapor bubbles in the low pressure region of the fuel system. In the starting case of the internal combustion engine, if excessively high temperatures prevail at the low pressure components of the fuel system, this can lead to a starting failure. Formation of vapor bubbles is understood to mean the premature evaporation of highly volatile fuel constituent parts in the fuel system. As a result, the high pressure pump can no longer convey any fuel (compressible fuel vapor is present instead of incompressible fuel) and a hot start of the internal combustion engine is no longer possible in some circumstances.

It is an object of the present invention to provide a method for avoiding the formation of vapor bubbles at excessively high temperatures in the low pressure region of the fuel system.

This and other objects are achieved by a method for starting an internal combustion engine wherein after a starting pulse for the internal combustion engine, the method checks whether a formation of vapor bubbles of gasoline is possible on the low pressure side during a hot start, and if not, then the normal low pressure is set. If possible, then a low pressure is set which is sufficiently high that a formation of the vapor bubbles is not possible on the low pressure side. The normal low pressure is set after a defined time period.

It is therefore proposed according to the invention to raise the maximum possible pressure level in the low pressure region of the fuel system. This can take place, for example, by way of the installation of a mechanical pressure regulator with an opening pressure which is elevated to, for example, approximately 10 bar with respect to the surroundings (instead of the 5.8 bar pressure regulator). Suitable combinations of characteristic data from the electronics of the internal combustion engine are used to detect that a critical starting case, as described above, might be present (high temperatures in the low pressure region of the fuel system with the risk of a formation of vapor bubbles). In order to make a reliable hot start possible, the pressure on the low pressure side of the fuel system is briefly raised to such a level (for example, approximately 10 bar, relative) during starting of the internal combustion engine that a formation of vapor bubbles in the fuel is impossible.

Since the method according to the invention relates to only a very small proportion of all starts of the internal combustion engine, the measure has two advantages in contrast to a constant pressure supply with a constantly high operating pressure (for example, a constant pressure of 10 bar, relative):

1. The pressure loading of the components of the fuel system is greatly reduced. The components of the fuel system can be designed for 10 bar loading according to the rules of fatigue strength instead of for continuous 10 bar loading. This reduces the costs for all relevant components.

2. A brief increase in the operating pressure leads only as required to a somewhat increased energy consumption of the fuel pump which generates the pilot conveying pressure (low pressure part). In contrast, a constant increase in the pressure level in the low pressure region of the fuel system leads to an energy consumption which is considerably increased in comparison with today.

Advantageous developments of the method according to the invention are further described herein.

The check and decision as to whether a critical hot start is present takes place using various criteria. Thus, the check can take place over a time window after the internal combustion engine is switched off. The maximum temperatures during reheating occur only after a certain switched-off time.

Furthermore, the check can take place via the determination of the coolant temperature and/or the lubricant temperature of the internal combustion engine.

A further option for checking is via a control unit. A calculation model or a characteristic diagram can be stored in the control unit. The gasoline temperature can be calculated via the model or can be read out from the characteristic diagram.

Alternatively or additionally, it can be determined using the monitoring of the high pressure level (fuel pressure in the high pressure region, downstream of the high pressure fuel pump) whether the measured actual high pressure profile follows the setpoint high pressure profile. If the high pressure level collapses during or shortly after a hot start (actual pressure<setpoint pressure), a formation of vapor bubbles in the low pressure region of the fuel system can be assumed. In this case, the fuel low pressure is likewise raised briefly as needed, with the result that a further formation of vapor bubbles is avoided and the high pressure pump can again convey liquid fuel for the build-up of high pressure.

Lowering of the pressure level in the low pressure region of the fuel system to a lower operating pressure, for example 5.8 bar with respect to ambient pressure, can take place when the fuel temperature is at a lower level again and a formation of vapor bubbles is therefore no longer possible. Depending on the fuel consumption of the internal combustion engine, this can already take place very rapidly in some circumstances, since the fuel volumetric flow which is throughput generally cools the relevant hot part regions of the low pressure fuel system in a very satisfactory manner.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
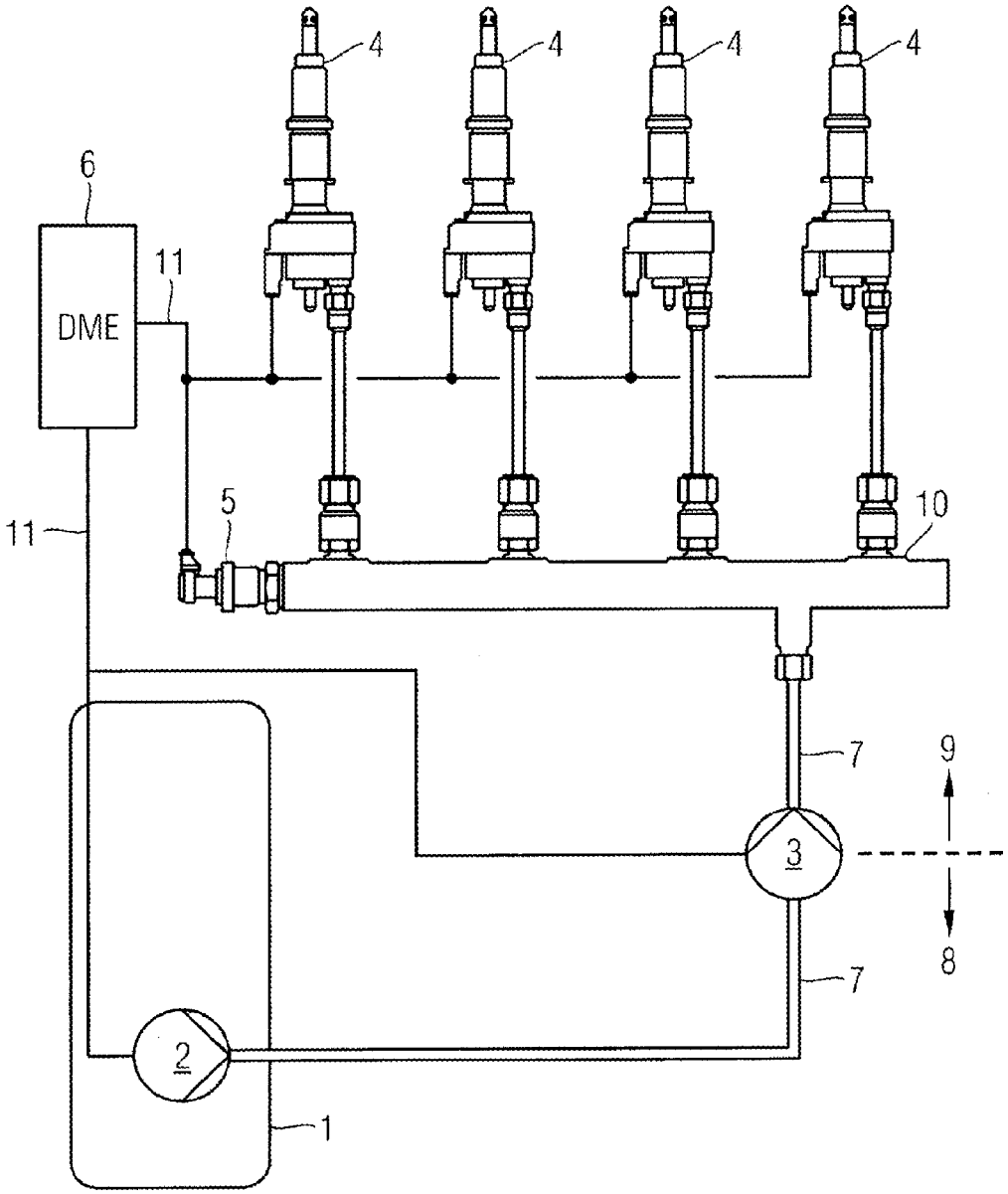
FIG. 1 is a schematic diagram showing a fuel system of the generic type for an internal combustion engine.

FIG. 1 diagrammatically shows a fuel system 1 of the generic type for a gasoline internal combustion engine (not shown), by way of which internal combustion engine the method according to the invention for starting the internal combustion engine can be carried out. Fuel is conveyed with the aid of a low pressure pump 2 out of a fuel tank 1 through a fuel line 7 to a high pressure pump 3. From the high pressure pump 3, the gasoline is conveyed further through the fuel line 7 into a rail 10. Four injectors 4 for injecting the gasoline into combustion chambers of the internal combustion engine are arranged on the rail 10. A fuel pressure sensor 5 is provided in the rail 10 for monitoring the high pressure of the fuel. A control unit 6 (DME) is connected via electrical connections 11 to the injectors 4, to the fuel pressure sensor 5, and to the low pressure pump 2 and the high pressure pump 3. The fuel system is divided into a low pressure region 8 and a high pressure region 9, represented by two arrows.

A fuel supply system of this type for an internal combustion engine can be used to provide a method for starting an internal combustion engine having a fuel tank 1 and a low pressure pump 2 which conveys the gasoline out of the fuel tank 1 at a low pressure to a high pressure pump 3 which conveys the gasoline at a high pressure to injectors 4 of the internal combustion engine. An electronic control unit 6 is provided for controlling and/or regulating the low pressure pump 2, the high pressure pump 3 and the injectors 4. After a start pulse for the internal combustion engine, the method:

checks whether a formation of vapor bubbles of the gasoline is possible on the low pressure side during a hot start, if not, then set the normal low pressure, if possible, then set a low pressure which is sufficiently high that a formation of vapor bubbles is not possible on the low pressure side, and set the normal low pressure after a defined time period.

In one aspect of the invention, the check takes place over a time window after switching off the internal combustion engine. It is to be noted that the maximum temperatures in reheating occur only after a certain switched-off time.

Furthermore, the check can take place via the determination of the coolant temperature and/or a lubricant temperature of the internal combustion engine by way of a temperature sensor.

A further option for checking consists in a calculation model or a characteristic diagram for determining the gasoline temperature being provided in the control unit 6. In the first case, the check can be calculated via the calculation model. In the second case, the check can be calculated by way of stored data being read out from a characteristic diagram.

A further option is to check via an actual high pressure measurement by way of the fuel pressure sensor 5. If the high pressure collapses during, or briefly after, a hot start (actual pressure<setpoint pressure), a formation of vapor bubbles in the fuel low pressure region 8 upstream of the high pressure pump 3 can be assumed. In this case, the fuel low pressure is likewise raised briefly as required, with the result that a further formation of vapor bubbles is avoided and the high pressure pump 3 can convey the liquid fuel for the build-up of high pressure.

Figure 2:
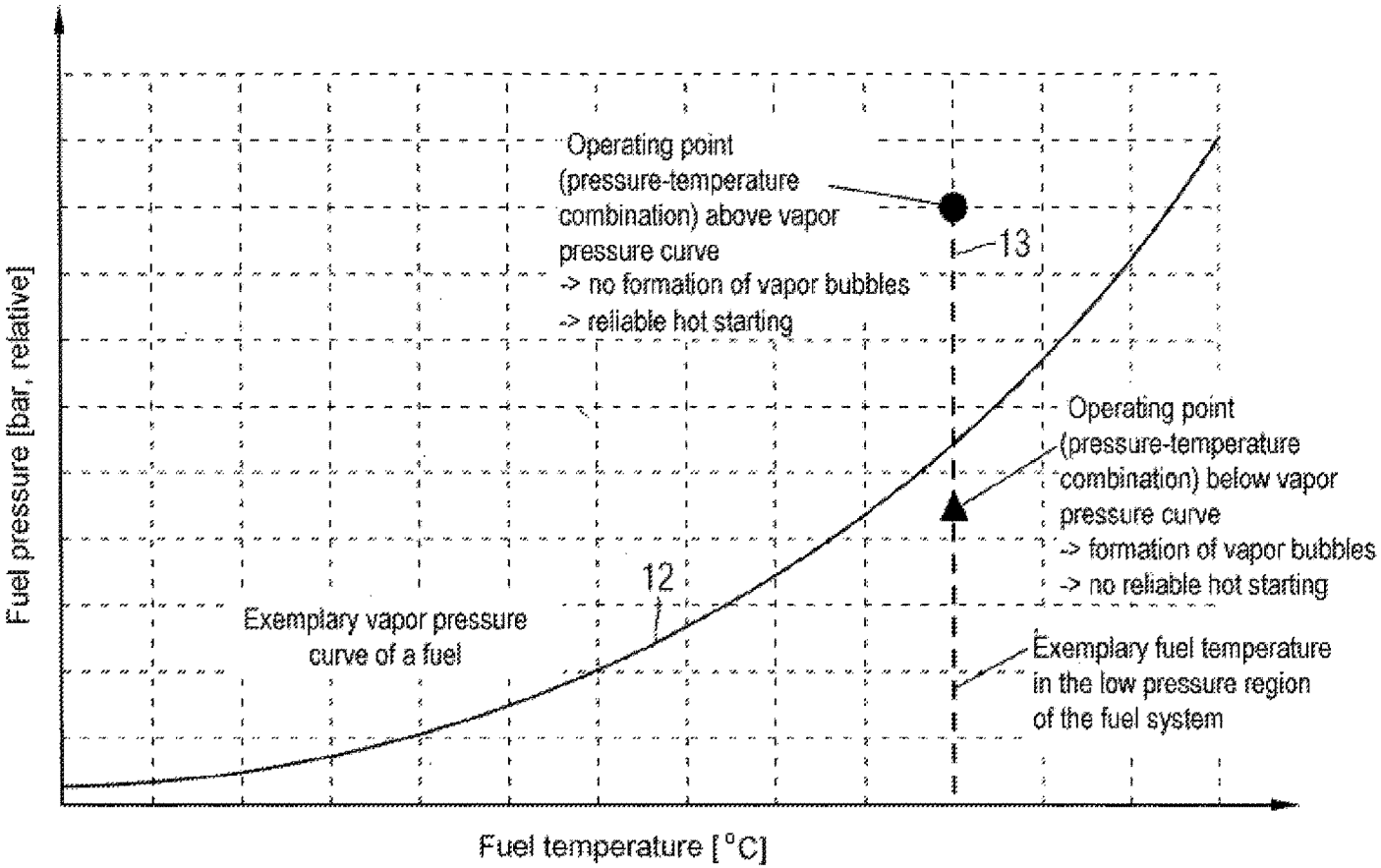
FIG. 2 is a graphical diagram of the relationship between the formation of vapor bubbles and the fuel system pressure.

FIG. 2 is a diagram with a vapor pressure curve 12 showing the relationship between the formation of vapor bubbles and a fuel system pressure of a fuel. The fuel pressure [bar] is plotted against the Y-axis, and the fuel temperature [° C.] is plotted against the X-axis. Dashed line 13 denotes a defined fuel temperature in the low pressure region 8 of the fuel system. A triangle shows an operating point (pressure-temperature combination) below the vapor pressure curve 12. A formation of vapor bubbles is possible at said temperature in conjunction with the prevailing pressure. A reliable hot start is therefore not ensured. The operating point is shifted above the vapor pressure curve 12 by way of the operating pressure being raised in a region which is shown by way of a circle. Therefore, a formation of vapor bubbles is no longer possible and a reliable hot start is ensured according to the invention.

Figure 3:
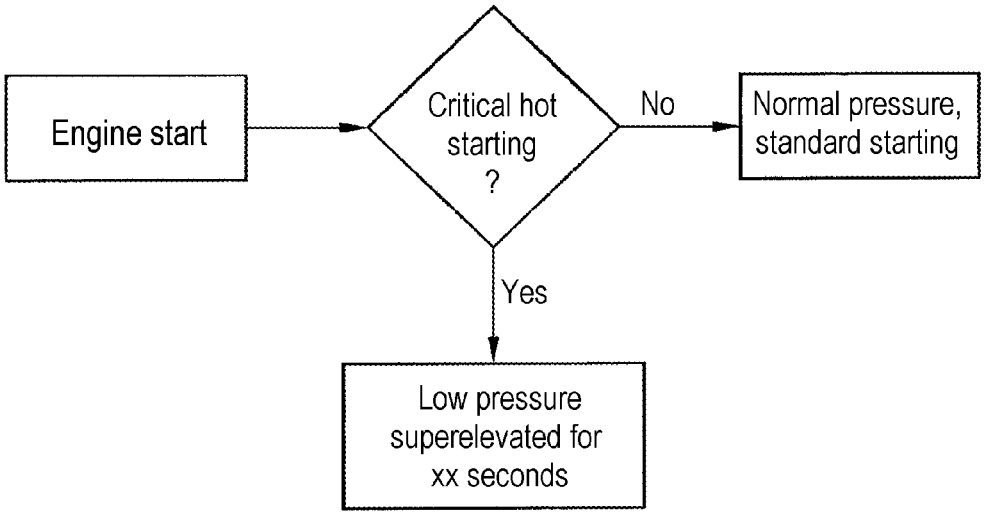
FIG. 3 is a flow diagram of the procedural logic.

FIG. 3 is a flow diagram showing the procedural logic for the method according to the invention for starting an internal combustion engine. After the start of the internal combustion engine, a check is made as to whether a formation of vapor bubbles of the gasoline is possible on the low pressure side during a hot start:

(i) if not, then the normal low pressure is set, (ii) if possible, then a low pressure is set which is sufficiently high that a formation of vapor bubbles is not possible on the low pressure side, and the normal low pressure is set after a time period.

LIST OF DESIGNATIONS:

1 Fuel (gasoline) tank
2 Low pressure pump
3 High pressure pump
4 Injector
5 Fuel pressure sensor
6 Control unit
7 Fuel line
8 Low pressure region

9 High pressure region
10 Rail
11 Electric connection
12 Vapor pressure curve
13 Operating temperature The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for starting an internal combustion engine having a fuel tank and a low pressure pump which conveys gasoline at a low pressure from the fuel tank to a high pressure pump, the high pressure pump conveying the gasoline at a high pressure to injectors of the internal combustion engine, wherein an electronic control unit controls and/or regulates the low pressure pump, the high pressure pump, and the injectors, the method comprising the acts of:

during a starting event of the internal combustion engine:

determining using the electronic control unit whether a temperature of the gasoline on the low pressure side is such that a formation of vapor bubbles in the gasoline is expected, if formation of vapor bubbles is determined to be expected, then setting the low pressure pump to generate a predetermined normal low pressure, or if formation of vapor bubbles is determined to not be expected, then setting the low pressure pump to generate a gasoline pressure at a level sufficient to suppress vapor bubble formation at the temperature of the gasoline, and then setting the predetermined normal low pressure after a defined time period, wherein the act of determining whether formation of bubbles is possible is based at least in part on a temperature of the gasoline estimated by a model or a characteristic diagram stored in the electronic control unit.

2. The method according to claim 1, wherein the act of checking takes place over a defined time window after the internal combustion engine is switched off.

3. The method according to claim 1, further comprising a temperature sensor for a coolant temperature and/or a lubricant temperature of the internal combustion engine, wherein the act of checking takes place via a determination of a coolant temperature and/or a lubricant temperature of the internal combustion engine.

4. A method for starting an internal combustion engine having a fuel tank and a low pressure pump which conveys gasoline at a low pressure from the fuel tank to a high pressure pump, the high pressure pump conveying the gasoline at a high pressure to injectors of the internal combustion engine, and a fuel pressure sensor provided on a high pressure side, wherein an electronic control unit controls and/or regulates the low pressure pump, the high pressure pump, and the injectors, the method comprising the acts of:

during a starting event of the internal combustion engine:

determining using the electronic control unit whether a temperature of the gasoline on the low pressure side is such that a formation of vapor bubbles in the gasoline is expected, if formation of vapor bubbles is determined to be expected, then setting the low pressure pump to generate a predetermined normal low pressure, or if formation of vapor bubbles is determined to not be expected, then setting the low pressure pump to generate a gasoline pressure at a level sufficient to suppress vapor bubble formation at the temperature of the gasoline, and then setting the predetermined normal low pressure after a defined time period, wherein the act of determining whether formation of bubbles is possible is based at least in part on an actual high pressure measurement via the fuel pressure sensor.

5. A method for starting an internal combustion engine having a fuel tank and a low pressure pump which conveys gasoline at a low pressure from the fuel tank to a high pressure pump, the high pressure pump conveying the gasoline at a high pressure to injectors of the internal combustion engine, and a fuel pressure sensor provided on a high pressure side, wherein an electronic control unit controls and/or regulates the low pressure pump, the high pressure pump, and the injectors, the method comprising the acts of:

during a starting event of the internal combustion engine:

determining using the electronic control unit whether a temperature of the gasoline on the low pressure side is such that a formation of vapor bubbles in the gasoline is expected, if formation of vapor bubbles is determined to be expected, then setting the low pressure pump to generate a predetermined normal low pressure, or if formation of vapor bubbles is determined to not be expected, then setting the low pressure pump to generate a gasoline pressure at a level sufficient to suppress vapor bubble formation at the temperature of the gasoline, and then setting the predetermined normal low pressure after a defined time period, wherein the act of determining whether formation of bubbles is possible is based at least in part on a temperature of the gasoline estimated by a model or a characteristic diagram stored in the electronic control unit and at least in part on an actual high pressure measurement via the fuel pressure sensor.

* * * * *